United States Patent [19]

Stuck et al.

[11] 4,405,296

[45] Sep. 20, 1983

[54] METALLIC PARTICLE GENERATION DEVICE

[75] Inventors: Earl N. Stuck, Wareham; Keith D. Pigney, Taunton; Howard Gifford, Westport, all of Mass.

[73] Assignee: Teledyne Industries, Inc., Los Angeles, Calif.

[21] Appl. No.: 427,900

[22] Filed: Sep. 29, 1982

Related U.S. Application Data

[62] Division of Ser. No. 300,224, Sep. 8, 1981, Pat. No. 4,374,789.

[51] Int. Cl.[3] ..... B22D 11/01

[52] U.S. Cl. ..... 425/6; 425/7; 425/10

[58] Field of Search ..... 425/6, 7, 10

[56] References Cited

U.S. PATENT DOCUMENTS

| | | | |
|---|---|---|---|
| 2,052,869 | 9/1936 | Coanda | 299/107 |
| 3,245,767 | 4/1966 | Sens et al. | 425/6 |
| 3,283,039 | 11/1966 | Walz et al. | 264/12 |
| 3,951,577 | 4/1976 | Okayama et al. | 425/7 |

*Primary Examiner*—James R. Hall

*Attorney, Agent, or Firm*—Shoemaker and Mattare, Ltd.

[57] ABSTRACT

A device for producing metallic particles utilizes the Coanda Effect to draw one stream of gas toward another stream of gas flowing over a foil. Molten metal is introduced between the two gas streams, and the resulting interaction breaks up the molten metal flow into particles of appropriate size, shape, composition and the like.

5 Claims, 2 Drawing Figures

METALLIC PARTICLE GENERATION DEVICE

This is a division, of application Ser. No. 300,224, filed Sept. 8, 1981, now U.S. Pat. No. 4,374,789.

BACKGROUND OF THE INVENTION

The present invention relates, in general, to metallurgical fields, and, more particularly, to production of shot, powder, and particle generation.

The process of shot peening is commonly used to create surface compressive stresses in stainless steel material (particularly in or near welded areas) for the prevention of stress corrosion cracking, which otherwise occurs when surfaces are exposed to heat water containing chlorides and subject to surface tensile stresses. The process is also used for improvement of fatigue resistance. Present production techniques for stainless steel shot involve cutting wire with or without subsequent processing to round the edges of the cuts. This process is neither cost-effective nor capable of producing truly spherical material.

Stainless steel shot is produced primarily by cutting a drawn wire and, in some cases, in the prior art, conditioning this wire to round the edges of the cut. This prior art process is costly and does not yield the spherical shape most desirable for purpose of shot peening. Metallic shot from certain metals can be produced in a shot tower where the molten metal is broken up by screening and allowed to cool by dropping the distance provided in the shot tower. Shot has also been produced in prior art methods by directing a stream of molten metal onto a rotating spinning disc which causes break-up of the metal by centrifugal force.

Other approaches are disclosed in U.S. Pat. Nos.: 2,308,584; 2,341,704; 2,523,454; 2,567,121; 2,636,219; 2,428,718; 3,891,730; and 3,951,577. All of the approaches disclosed in these patents involve the intersection of a stream of fluid and a stream of molten metal to break up that stream of molten metal and produce shot.

Powders used in powder metallurgy, compacting or sintering, are frequently broke up by high pressure water streams or may be produced by rotary spinning devices as used for some types of shot.

The above-discussed processes do not provide the degree of adjustability and versatility required for modern techniques, nor do such processes readily provide ability to introduce modifying elements into the particles.

SUMMARY OF THE INVENTION

The process and device embodying the teachings of the present invention provide a cost effective means of producing spherical particles having desired characteristics.

The operation of the device embodying the teachings of the present invention is based upon the Coanda Effect. As herein used, the Coanda Effect is defined as "the tendency of a gas or liquid coming out of a jet to travel close to a wall contour, even if the wall curves away from the axis of that jet."

The device embodying the teachings of the present invention includes a hollow container into which various gases are forced under pressure. The container has an arcuate surface on one side thereof. This arcuate surface forms the Coanda surface, and a narrow adjustable slit is provided in the container to permit the gas to escape at a selected velocity, tangent to the curvature of the curved surface and adjusted to produce attachment to that surface. The slit is also sized and dimensioned so that gases passing therethrough will achieve a velocity sufficiently high to cause this gas flow to "attach" to and follow the curved surface. (This gas flow is identified as the primary gas flow.) In so doing, the attached gases will cause surrounding atmosphere to be entrained in volumes several times that of the primary gas. When molten metal is introduced from a reservoir into the entrainment zone, that molten metal is captured between the primary and entrained gas streams, broken up and discharged from the curved surface. The molten metal is held away from the curved surface by the primary gas flow which creates a protective barrier between the molten stream and that surface. This molten metal is broken into particles by the forces of entrainment.

Size and shape of the particles can be influenced by regulation of metal temperature, gas pressure, slit opening, quenching medium, metal flow configuration (flow may be "shaped" by constrainment of the opening through which that flow passes), curved surface configuration (attachment can be influenced by a variety of profiles), slit location with respect to the curved contour, attitude of molten metla flow introduction, or the like.

By variation of the gas used for primary flow and for the surrounding entrainment atmosphere, it is possible to introduce desirable, or exclude undesirable, properties and surface conditions. A distinct advantage of the presently disclosed device over prior art devices is the absence of moving parts, and a major protective feature results from the primary gas flow bearing effect which prevents abrasion of the curved surface by the molten metal.

Depending upon the temperatures required for various metals, the device may be constructed of high temperature alloys, ceramics, alumina composition, or the like. It is also noted that the device is continuously being cooled by the gas required in the process. Cooling of the particles also affects shape, with the more spherical particles being produced when they are permitted to solidify within the gaseous atmosphere rather than being quenched in a liquid.

The entire process is conducted in a container which forms a large chamber which can be filled with various gases and provided with a reservoir at the bottom thereof to hold coolant/quenching liquid.

Because of the high volume entrainment characteristics of the present device, extensive disintegration of the molten stream occurs by virtue of the introduction of relatively small volumes of gas.

Particles generated by a process using the presently disclosed invention will be endowed with properties permitting better, more homogeneous compacting capability which may allow the teachings of the present disclosure to be applied to cold compacting processes, forging, or the like.

Generation of powder and particles required in powder metallurgy or compacting may also be enhanced by this process due to the potential for shape and size control as well as possible modification of properties and/or surface by gaseous impingement.

OBJECTS OF THE INVENTION

It is a main object of the present invention to convert a stream of molten metal into particles of various size and shape for use in shot peening, powder metallurgy, compacting, sintering, or the like.

It is another object of the present invention to take advantage of the Coanda Effect for generation of metal particles of various size and shape.

It is still another object of the present invention to permit the introduction of a variety of gaseous atmospheres which may be used to impart specific surface conditions and/or properties to the particles generated.

It is yet another object of the present invention to permit volume control of both primary gas flow and entrained atmosphere for the purpose of controlling particle size and shape.

It is a further object of the present invention to produce stainless steel and other difficult-to-produce shot material cost-effectively for shot peening purposes.

It is still a further object of the present invention to produce powders suitable for use in powder metallurgy, compacting or sintering.

It is yet a further object of the present invention to provide a device for metallic particle generation which has no moving parts.

These together with other objects and advantages which will become subsequently apparent reside in the details of construction and operation as more fully hereinafter described and claimed, reference being had to the accompanying drawings forming part hereof, wherein like reference numerals refer to like parts throughout.

DETAILED DESCRIPTION OF THE INVENTION

Figure 1:
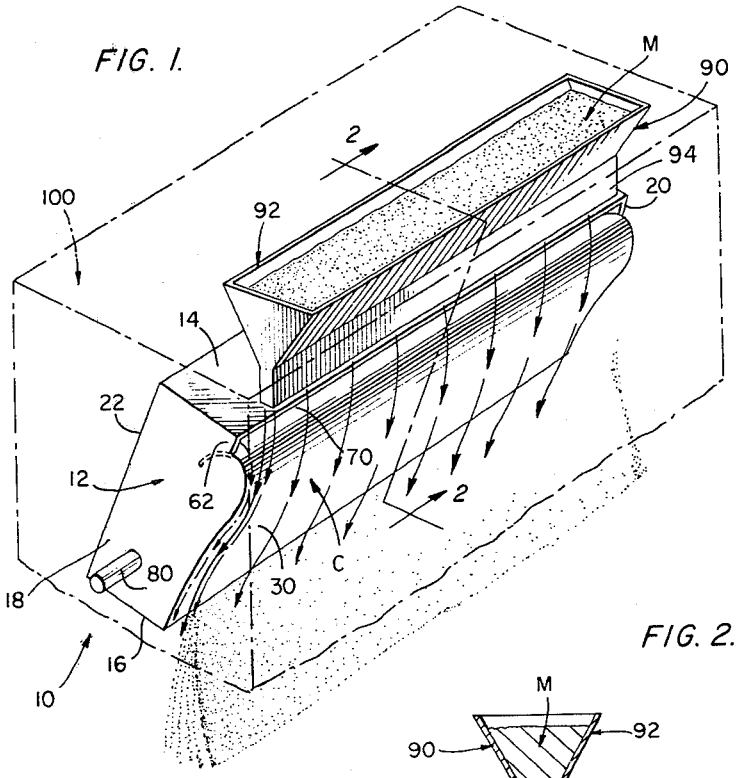
FIG. 1 is a perspective view of a device embodying the teachings of the present invention.

Shown in FIG. 1 is a device 10 for producing particles of various shapes, sizes and compositions. The device 10 includes a hollow chamber defining housing 12 which includes a top 14, a bottom 16, sides 18 and 20, and a planar rear wall 22.

Figure 2:
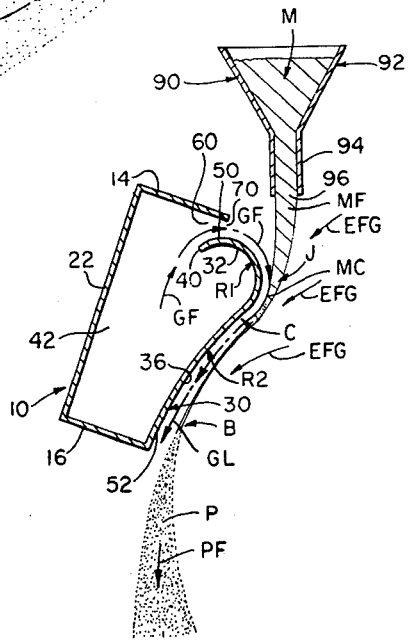
FIG. 2 is a view taken along line 2—2 of FIG. 1.

The housing further includes a sinuous front 30 which is best shown in FIG. 2 to include an arcuate top portion 32 having a radius of curvature R1 which smoothly and integrally joins an arcuate bottom portion 36 which has a radius of curvature R2. As shown in FIG. 2, the front 30 forms a type of ogee curve with the radii R1 and R2 producing curvatures which are opposite to each other with R2 exceeding R1. The top portion 32 has an end edge 40 located inside chamber 42 defined in the housing 12, and the bottom portion 36 has a lower end edge integrally joined to the housing bottom 16.

As best shown in FIG. 2, the arcuate top portion 32 has an outer surface 50 and the bottom portion 36 has an outer surface 52 with the surfaces 50 and 52 forming a continuous, arcuate, sinuous surface. This surface forms a foil and is designated hereinafter as Coanda surface C, and is shaped and sized to produce the afore-mentioned Coanda Effect according to principles of fluid dynamics and boundary layer theory known to those skilled in the art.

It is here noted that the Coanda Effect, as well as many of the related flow effects utilized in carrying out the present invention, is influenced and controlled by surface properties of the housing such as friction coefficients, dimensions, and the like, as well as fluid state properties such as static or stagnation pressures, temperature, enthalpy, density, and the like, as well as the fluid characteristics themselves. Selection of these parameters will be controlled according to theories, relationships, equations and the like known to those skilled in the arts of fluid mechanics and metallurgy. The present disclosure will provide guidance to such skilled artisans regarding results, operations, functions and the like, and these skilled artisans can refer to basic textbooks, such as: *Mechanics of Fluids,* by Irving Shanes, published by McGraw-Hill Book Company, Inc., with a Library of Congress Catalog Card No. 61-18731; *Handbook of Fluid Dynamics,* edited by Victor L. Streeter, University of Michigan Press; *Gas Dynamics,* by A. B. Cambel and B. H. Jennings, Northwestern University, McGraw-Hill Series in Mechanical Engineering; *Boundary Layer Theory,* 4th Edition, by Herman Schlicting, University of Braunschweig, Germany, translated by J. Kestin, Brown University, McGraw-Hill Series in Mechanical Engineering; *The Dynamics and Thermodynamics of Compressible Fluid Flow,* Voumes 1 and 2, by Ascher H. Shapiro, The Ronald Press Company, New York; or the like; papers; or patents such as: U.S. Pat. Nos. 2,052,869; 4,014,487; 3,999,696; 4,035,870; 4,136,808; and 4,147,287; for other teaching regarding the details of carrying out the present invention based on the teaching of the present disclosure. To the extent required to practice this invention, such papers, patents and textbook discussions are incorporated herein by the reference thereto. A complete discussion of the considerations required to properly design the Coanda surface C will thus not be presented herein because of the existence of such textbooks, papers, patents and the like. The proper design of such surface, and selection of other elements in fluids to produce a specific result will depend upon the parameters which will be apparent to those skilled in the pertinent arts from the ensuing disclosure and from the knowledge possessed by such skilled mechanic.

As shown in FIG. 2, top outer surface 50 is spaced from the housing top 14 to define a gap 60. The gap 60 has a size and shape as determined by the size and shape of the surface 50 because top 14 is planar. Accordingly, the size and shape of Coanda surface C further influences flow patterns and effects of any fluid flowing in the gap 60 as will be apparent from this disclosure. The gap 60 is closed along the side edges by lips 62 depending from the top 14 as shown in FIG. 1. The gap 60 thus defines an exit slit 70 and any fluid flowing therein can attach to that surface 50. The location of attachment, separation, or the like, can be controlled by the shape of surface 50 as well as the flow vectors of the fluid flowing through the gap 60.

A gas inlet means includes an inlet conduit 80 attached to side 18 of the housing and fluidly attaching the interior of the housing with a fluid source (not shown) via suitable valves, plenums, gauges and the like which are used to adjust the flow of fluid into the interior of the housing to define a pressure for that fluid suitable to establish the desired flow through slit 70. This flow is indicated in FIG. 2 by arrows GF.

Due to friction and the like between the flow GF and the gas in the environment surrounding the device 10, a flow gradient of such environmental gas will be established due to flow GF. This flow gradient is indicated in FIG. 2 by arrows EFG. This flow gradient generally follows the direction of gas flow GF and thus has a "shape" influenced by the shape of the Coanda surface C which influences the "shape" of the flow GF.

The environmental gas thus tends to merge with the gas in flow GF, and for this reason can be identified as "entrained gas" as it merges with the gas in flow GF. The gas in gradient EFG initially contacts the gas in flow GF at a location identified in FIG. 2 as area J. Due to the shape of the surface C, the flows GF and EFG will tend to intersect; however, as will be discussed below, this intersecting and mixing is postponed, but is not prevented.

As shown in FIGS. 1 and 2, a reservoir 90 is positioned adjacent the housing 12. The reservoir includes a trough 92 fluidly connected to an exit section 94 thereof. The trough is funnel shaped in cross-section as is shown in FIG. 2. The exit section depends from the trough 92 and has an elongate exit port 96 located adjacent Coanda surface C and slit 70.

Molten metal M is located in the reservoir 90, and flows out of the exit port 96 as indicated by reference indicator MF in FIG. 2. Flow MF is a sheet and is a gravity flow in the preferred embodiment.

The exit port 96 is located so that molten metal is introduced adjacent the Coanda surface and is present at or near location J. The molten metal is also entrained and "separates" the gas flows GF and EFG which would otherwise intermix with each other beginning at location J. The exit port can be oriented relative to the attitude of the Coanda surface adjacent location J to ingest molten metal at an angle with respect to vertical selected to produce the most effective operation of device 10. As above, the size, shape and location of the exit port 96 is selected so that flow MF is properly influenced by the afore-mentioned flows to establish the flow pattern shown in FIG. 2 and indicated by the reference indicator MC. The proper dimensions, spacings and flow parameters for the flow MF and the exit port 96 are determined according to the considerations of proper and desired flow MC, and will be determined according to the guidance provided by the referenced material.

As the metal in flow MF is denser than the fluid in flow GF, and due to the placement of exit port 96 relative to the Coanda surface C, the flow GF, which is influenced by the Coanda surface portion 50 to intersect the metal flow, is contained between the molten metal flow MF and the Coanda surface C to produce a shielding layer of gas GL as shown in FIG. 2. Due to the presence of the molten metal flow MC, the afore-discussed intermixing of flows GF and EFG is prevented from occurring at or near location J. However, the flow of the three fluids will be adjusted according to the usual flow parameters, such as pressure, temperature, friction co-efficients, and the like, as well as the flow and physical characteristics of the flows so that the flows GF and EFG continue along intersecting paths and intermixing of the flows GF and EFG is postponed until a location B is reached by the three flows. Thus, intermixing of flows GF and EFG is postponed but is not prevented.

Due to the influence of gravity, flow separation effects, and the like, the fluid streams GF and EFG finally achieve intermixing at location B. This intermixing of flows GF and EFG occurs as the molten metal flow MC breaks up into a multiplicity of particles P which flow in a direction and at a velocity determined by the usual flow theories. This break-up may occur quickly or gradually according to flow parameters and the like. It is understood, however, that location B may be an area and the break-up may be gradual. The sharp demarcation indicated in FIG. 2 for locations J and B is not intended to be limiting, as will be understood by those skilled in the art. Flow of particles is indicated in FIG. 2 by the reference indicator PF.

The entire process can be conducted in a container 100 which has a reservoir associated therewith (not shown) for collecting the particles. The container 100 is shown partially broken away to indicate the presence of a suitable reservoir beneath the device 10. The container 100 can also be filled with suitable gases at suitable pressures and temperatures to establish a flow EFG desired for the environmental gas. The gas in the container 100 is the environmental gas in such an instance.

Various shapes and dimensions for surface C, pressures and other flow parameters for fluid flow MF and GF as well as EFG can be selected to establish the desired particle size and shape for particles P, as well as the production rate of such particles. The pressures, temperatures, physical parameters, and other state properties and flow influencing parameters of both of the fluids as well as the molten metal flow can be varied according to known theories to produce the desired particles. A full discussion of such parameter selection will not be presented herein, as one skilled in the art of metallurgy and/or fluid mechanics can consult standard reference material, such as the material referenced above, to determine such conditions based upon the guidance provided by the present disclosure.

The process is started by establishing flow GF which thereby establishes flow EFG, then establishing flow MF. The process of entrainment of flow EFG continues even though flow MF is occurring because the flow sheet of MF produces the afore-mentioned friction effects, which initially established flow EFG, also between flows MC and EFG. The direction of the flow gradient EFG remains oriented so that flows GF and EFG still tend to intermix even though flow MC is present. Turbulence and fluid momentum, as well as the afore-discussed principles cause this continued trend toward intermixing of flows GF and EFG. Thus, once begun, the process continues to produce metallic particles P.

Appropriate quenching means or the like can be included to transform the particles P into the suitable metallic particles. Other means can also be used without departing from the scope of the present disclosure.

The required quenching can even be effected using the transit time of particles P in the environmental fluid used as the source of flow EFG.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

We claim:

1. A device for producing metallic particles comprising:

means defining a Coanda surface;

means for flowing a first fluid along said Coanda surface;

a second fluid located adjacent said Coanda surface to be influenced by the flow of said first fluid toward an intersection with said first fluid;

means for introducing a flow of molten metal between said first and second fluids, said molten metal being introduced between said fluids, the entrainment of said molten metal postponing but not preventing intersection of said fluids;

intersection between said first and second fluids occurring at a location spaced from the location of molten metal introduction between said fluids, where said flow of molten metal is broken up so that metallic particles can be formed.

2. The device defined in claim 1 further including means for controlling the state properties of said fluids.

3. The device defined in claim 2 further including a housing having one side thereof including said Coanda surface.

4. The device defined in claim 3 wherein said housing has a chamber defined therein and means for introducing said first fluid into said chamber and a fluid exit means defined on said housing adjacent said Coanda surface.

5. The device defined in claim 1 wherein said molten metal flow introducing means is elongate to define a sheet of molten metal.

* * * * *